US011330907B1

(12) United States Patent
Frisch

(10) Patent No.: US 11,330,907 B1
(45) Date of Patent: May 17, 2022

(54) CHAIR WITH ARMREST CONNECTORS

(71) Applicant: Thomas Frisch, Wilmington, DE (US)

(72) Inventor: Thomas Frisch, Wilmington, DE (US)

( * ) Notice: Subject to any disclaimer, the term of this patent is extended or adjusted under 35 U.S.C. 154(b) by 0 days.

(21) Appl. No.: 17/566,343

(22) Filed: Dec. 30, 2021

(51) Int. Cl.

| | |
|---|---|
| ***A47C 3/04*** | (2006.01) |
| ***A47C 1/14*** | (2006.01) |
| ***A47C 4/28*** | (2006.01) |
| ***A47C 4/44*** | (2006.01) |
| ***A47C 7/54*** | (2006.01) |
| ***A47C 7/62*** | (2006.01) |
| ***A47C 4/52*** | (2006.01) |
| ***A45F 3/04*** | (2006.01) |
| ***A47C 1/124*** | (2006.01) |
| ***A47C 9/10*** | (2006.01) |
| *A45F 4/02* | (2006.01) |

(52) U.S. Cl.

CPC ..... *A47C 4/44* (2013.01); *A45F 3/04* (2013.01); *A47C 1/124* (2013.01); *A47C 1/14* (2013.01); *A47C 3/04* (2013.01); *A47C 4/28* (2013.01); *A47C 4/52* (2013.01); *A47C 7/54* (2013.01); *A47C 7/543* (2013.01); *A47C 7/546* (2013.01); *A47C 7/62* (2013.01); *A47C 9/10* (2013.01); *A45F 2004/026* (2013.01)

(58) Field of Classification Search

CPC .. A47C 4/44; A47C 1/124; A47C 1/14; A47C 3/04; A47C 4/28; A47C 4/52; A47C 7/54; A47C 7/543; A47C 7/546; A47C 7/62; A47C 9/10; A45F 3/04; A45F 2004/026

USPC ..... 297/16.2, 17, 232, 239, 243, 411.23; 224/155

See application file for complete search history.

(56) References Cited

U.S. PATENT DOCUMENTS

| | | | | | |
|---|---|---|---|---|---|
| 3,614,157 | A | * | 10/1971 | Hendrickson | A47C 1/124 297/248 |
| 3,669,491 | A | * | 6/1972 | Weslock | A47C 1/124 24/339 |
| 3,825,300 | A | * | 7/1974 | Lieberman | A47C 1/124 297/248 |
| 4,224,721 | A | * | 9/1980 | Ohlson | F16B 7/0433 248/68.1 |
| 5,297,708 | A | | 3/1994 | Carpenter | |
| 5,318,342 | A | | 6/1994 | Hale | |

(Continued)

*Primary Examiner* — Robert Canfield

(74) *Attorney, Agent, or Firm* — Boudwin Intellectual Property; Daniel Boudwin

(57) ABSTRACT

A chair with armrest connectors includes a backrest, a seat, a pair of armrests, and a supporting frame configured to move the chair between a folded configuration and a deployed configuration. A pair of connectors are secured within cavities disposed on an upper surface of each armrest. The connectors are configured to move between a deployed position extending outwardly from the cavities and a retracted position within the cavities. When deployed, the connectors are configured to removably secure to a supporting frame of a second chair. This allows for multiple chairs to be secured to each other when in a folded configuration. The chair includes adjustable shoulder straps that allow an individual to easily carry the assembly of attached folded chairs supported against the individual's back. The chair may also include additional fasteners or connection mechanisms for supporting additional items against the front side of the individual for improved weight distribution.

12 Claims, 9 Drawing Sheets

(56) References Cited

U.S. PATENT DOCUMENTS

| | | | | |
|---|---|---|---|---|
| 5,542,159 | A * | 8/1996 | Schultz | A47C 1/124 24/341 |
| 5,588,696 | A | 12/1996 | Jay et al. | |
| D547,981 | S | 8/2007 | Cohen | |
| 7,325,875 | B1 | 2/2008 | Guerrini | |
| D571,115 | S | 6/2008 | Cohen | |
| 9,049,916 | B2 | 6/2015 | Berei | |
| 9,185,983 | B1 | 11/2015 | Cohen | |
| 11,168,836 | B2 * | 11/2021 | Kelly | F16B 7/0493 |
| 2009/0256401 | A1 * | 10/2009 | Hensley | A47C 4/32 297/45 |
| 2013/0214565 | A1 | 8/2013 | Nickell | |
| 2015/0366357 | A1 * | 12/2015 | Nelson | A47C 5/10 224/155 |
| 2019/0045908 | A1 * | 2/2019 | Zhu | A45F 3/14 |
| 2019/0374033 | A1 | 12/2019 | Grace | |
| 2020/0214451 | A1 | 7/2020 | Garrison | |
| 2020/0229606 | A1 * | 7/2020 | Liu | A47C 7/62 |
| 2020/0268131 | A1 | 8/2020 | McDowell | |

* cited by examiner

CHAIR WITH ARMREST CONNECTORS

BACKGROUND OF THE INVENTION

The present invention relates to folding chairs. More specifically, the present invention provides a folding chair having retractable connectors disposed within each armrest that facilitates the attachment and detachment of multiple chairs to one another when the chairs are in a folded or otherwise collapsed configuration, thus allowing the attached assembly of collapsed chairs to be easily carried by an individual via one or more supporting straps.

Folding chairs are commonly used in recreational settings, such as when visiting the beach, for example. These types of chairs are able to move between an expanded configuration for use and a folded configuration for more compact storage and easier transportation. Despite the ability to fold to a smaller profile, it can be difficult for a single individual to carry multiple folded chairs at once. Often, the chairs are difficult to grasp and may unfold while being carried, potentially causing the individual to drop the chairs. One solution is to transport multiple chairs in a wagon or similar pulled vehicle. However, such vehicles are bulky, difficult to maneuver in sand, and potentially expensive.

Some folding chairs include straps that facilitate easier transport, including shoulder straps that allow the chair to be supported against the individual's back when being carried in the folded position. However, such straps only apply to a single folded chair, and do not facilitate attachment or securement of additional chairs. It would be difficult or impossible for the individual to secure each individual chair's straps to themselves in an effective manner. In view of the above concerns, it is desirable to provide a folding chair having an armrest with retractable connectors that can be selectively deployed to secure multiple folded chairs to one another, thus allowing the folding chairs to be easily carried by an individual when supported via one or more straps.

Devices have been disclosed in the known art that relate to folding chairs having components that facilitate transport or storage of the folding chair and other items. These include devices that have been patented and disclosed in patent application publications. However, the devices in the known art have several drawbacks. For example, the devices in the known art are typically separate accessory attachment devices, such as brackets, adapters, and the like, that are not integrated within the chair itself. It can be difficult and expensive to acquire and assemble such devices, which typically only facilitate attachment of various accessories and not additional chairs. Such devices further lack the means for storing an attachment connector or similar mechanism within the structure of the chair, such that it remains connected to the chair for convenience without obstructing or otherwise interfering with regular use of the chair.

In light of the devices disclosed in the known art, it is submitted that the present invention substantially diverges in design elements from the known art and consequently it is clear that there is a need in the art for an improvement to existing folding chair devices and related accessories, particularly with regard to the above-described need for a folding chair having retractable armrest connectors that allow multiple folding chairs to be secured to one another for easy transport when being carried by an individual via one or more supporting straps. In this regard the present invention substantially fulfills these needs.

SUMMARY OF THE INVENTION

The present invention provides a folding chair with a pair of armrests each having at least one retractable connector, wherein the same can be utilized for securing multiple folded chairs to each other to facilitate transport by an individual using supporting straps that are attached to one or more of the folded chairs. The chair with armrest connectors generally includes chair with a backrest portion, a seat portion, a pair of armrests, and a supporting frame configured to move the chair between a folded configuration and a deployed configuration. A connector is secured within a cavity disposed on an upper surface of each armrest, via a mounting peg or similar mechanism that permits rotation of each connector. Each connector is configured to move between a deployed position extending outwardly from each cavity and a retracted position within each cavity. A locking mechanism is configured to selectively maintain each connector in the deployed position, and can be actuated to release each connector and allow each connector to rotate back to the retracted position when not in use.

When deployed, each connector is configured to removably secure to a supporting frame of a second chair. This allows for multiple chairs to be secured to each other when in a folded configuration. The chair also includes adjustable shoulder straps that allow an individual to easily carry the assembly of attached folded chairs supported against the individual's back. The chair may also include additional support features attached to the supporting straps for securing additional items against the front side of the individual for improved weight distribution. In this way, the present invention assists an individual with carrying multiple chairs and other objects at the same time, while their hands remain free to use.

A primary object of the present invention is to provide a folding chair with armrest connectors that can be retracted into the armrest when not in use, such that they do not obstruct or otherwise interfere with use of the armrest by an individual seated in the chair.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
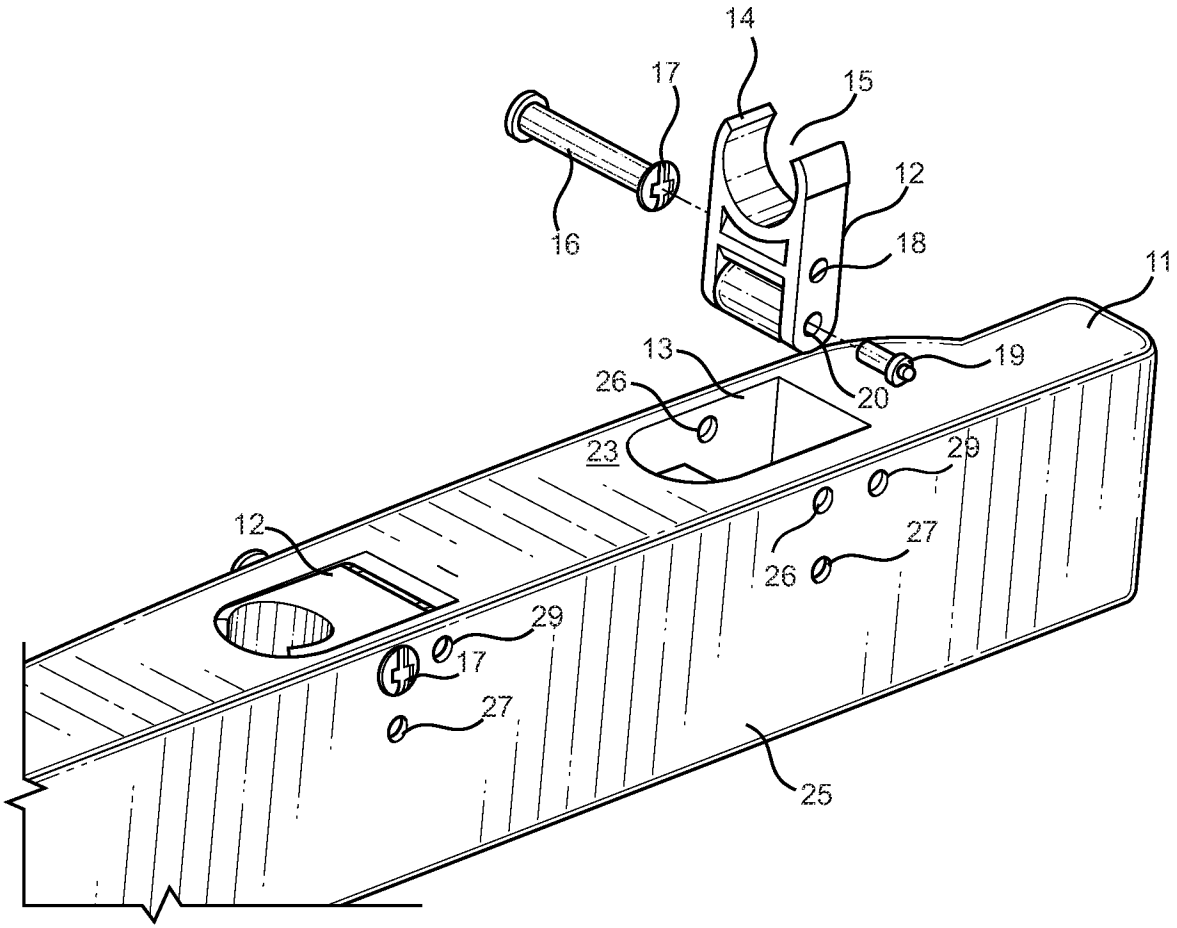
FIG. 1 shows an expanded perspective view of the armrest component of an embodiment of the chair with armrest connectors.

Reference is made herein to the attached drawings. Like reference numerals are used throughout the drawings to depict like or similar elements of the chair with armrest connectors. For the purposes of presenting a brief and clear description of the present invention, a preferred embodiment will be discussed as used for providing a means for securing multiple folded chairs together in such a way that facilitates transport by an individual via one or more supporting straps.

Referring now to FIG. 1, there is shown an expanded perspective view of the armrest component of an embodiment of the chair with armrest connectors. As used herein, the term "connector" is intended to encompass any suitable type of connection mechanism that facilitates the attachment of multiple chairs to one another. While the term "connector" is chosen out of simplicity for referencing the shown embodiment, other embodiments may include different types of connection mechanisms, including but not limited to clips, straps, clamps, fasteners, and the like. The chair includes a pair of armrests 11. Each armrest includes at least one connector 12. In the shown embodiment, the armrest 11 includes a pair of connectors 12, but different embodiments may include a single connector 12 or additional connectors 12. In the shown embodiment, each connector 12 includes a pair of opposing jaws 14 defining a center opening 15. The center opening 15 is sized to receive a portion of an adjacent chair's frame, while the jaws 14 are flexible yet biased inwardly such that they deform to receive the frame and then resiliently act upon the received frame to secure it within the connector 12.

The connectors 12 are mounted within a cavity 13 disposed on the upper surface 23 of each armrest 11. Each connector 12 is configured to move between a deployed position extending outwardly from the cavities 13 and a retracted position within the cavities 13. This allows the connectors 12 to be deployed for use and retracted for unobstructive storage when not needed. In the shown embodiment, each connector 12 is removably secured within the cavities 13 via a mounting peg 16 extending through a pair of apertures 26 on opposing sides of the cavities 13. The mounting peg 16 extends through a pair of mounting peg apertures 18 on each connector 12. Further, the mounting peg 16 includes a fastener 17 configured to removably secure the mounting peg 16 within the pair of apertures 26. This permits removal of each connector 12 if needed. In the shown embodiment, the fastener 17 includes a threaded screw fastener, but any suitable type of fastener 17 may be utilized.

Each connector 12 includes a locking mechanism 19 configured to selectively maintain the connector 12 in the deployed position. Each locking mechanism 19 is mounted to each connector 12 via a locking mechanism aperture 20 disposed on each connector 12. In the shown embodiment, each locking mechanism 19 comprises an actuator 22 configured to release each connector 12 from the deployed position when actuated. Each locking mechanism 19 can include a spring-loaded ball detent type mechanism or any other suitable mechanism that biases the actuator 22 toward a locked position. The actuator 22 extends through either one of an upper actuator aperture 29 or a lower actuator aperture 27 on the side 25 of the armrest 11. When the connector 12 is in the retracted position, the actuator 22 extends through the upper actuator aperture 29. When the connector is in the deployed position, the actuator 22 extends through the lower actuator aperture 27. When the actuator 22 is pressed far enough within either of the actuator apertures 27 or 29, it allows for unlocking of the locking mechanism 19 and rotation of each connector 12 to the desired position.

Figure 2:
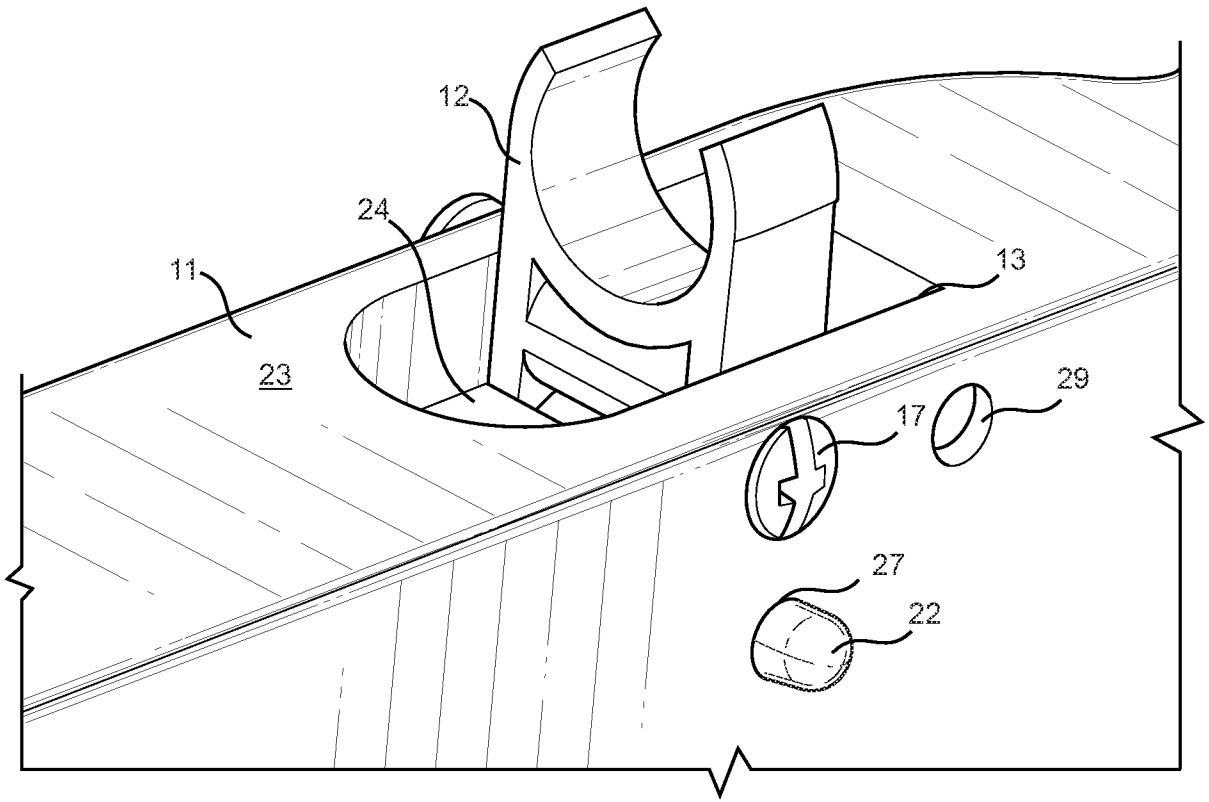
FIG. 2 shows a perspective view of the armrest component of an embodiment of the chair with armrest connectors showing the armrest connector in a deployed position.
Figure 3:
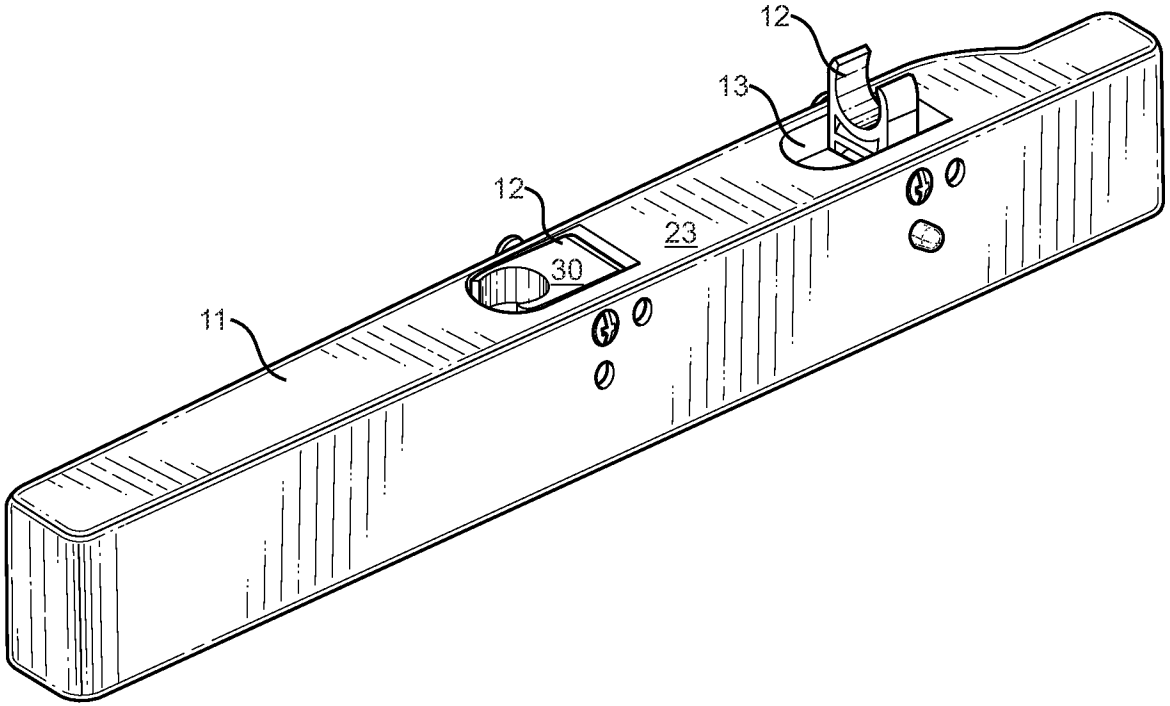
FIG. 3 shows a perspective view of the armrest component of an embodiment of the chair with armrest connectors showing a first armrest connector in a deployed position and second armrest connector in a retracted position.

Referring now to FIGS. 2 and 3, there are shown a perspective view of the armrest component of an embodiment of the chair with armrest connectors showing the armrest connector in a deployed position and a retracted position. In the shown embodiment, the cavity 13 includes an internal stop member 24 that is configured to prevent the connector 12 from over-rotating into the cavity 13 when the connector 12 is in the folded position to help maintain it flush with the upper surface of the armrest 23. As shown in FIG. 3, an outer surface 30 of the connector 12 is aligned flush with an upper surface 23 of the armrest 11 when the connector 12 is in the retracted position. This provides a smooth surface for the user of the armrest 11, and ensures that the connectors 12 do not obstruct or otherwise occupy space on the armrest 11 when the chair is in use.

Figure 4A:
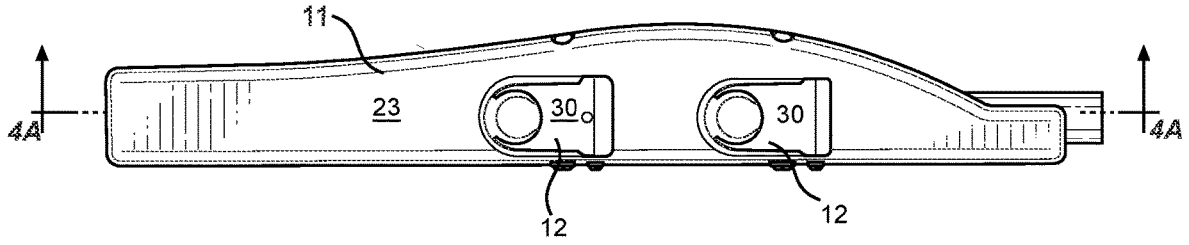
FIG. 4A shows a top plan view of the armrest component from an embodiment of the chair with armrest connectors.
Figure 4B:
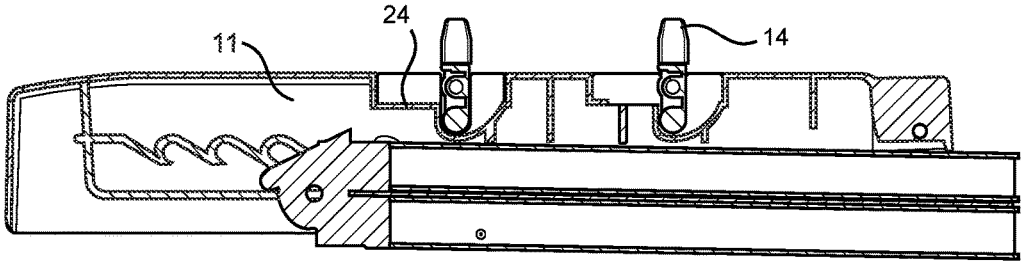
FIG. 4B shows a cross-sectional side view of the armrest from an embodiment of the chair with armrest connectors.

Referring now to FIGS. 4A and 4B, there is shown a top plan view of the armrest component from an embodiment of the chair with armrest connectors and a cross-sectional side view of the armrest from an embodiment of the chair with armrest connectors, respectively. FIG. 4A shows the retracted connectors with the surface 30 laying flush with the upper surface 23 of the armrest 11, which prevents the connectors 12 from interfering with the armrest. As shown in FIG. 4B, the armrest 11 can be adjustably secured to a portion of the chair frame. In other embodiments, the armrest 11 may be fixed in position. Further, the stop member 24 helps maintain the proper positioning of the connectors 12 when they are in either the deployed or retracted positions. To move the connectors 12, the user can depress the locking button, grasp the jaws 14, and rotate in either direction to achieve the desired position.

Figure 5:
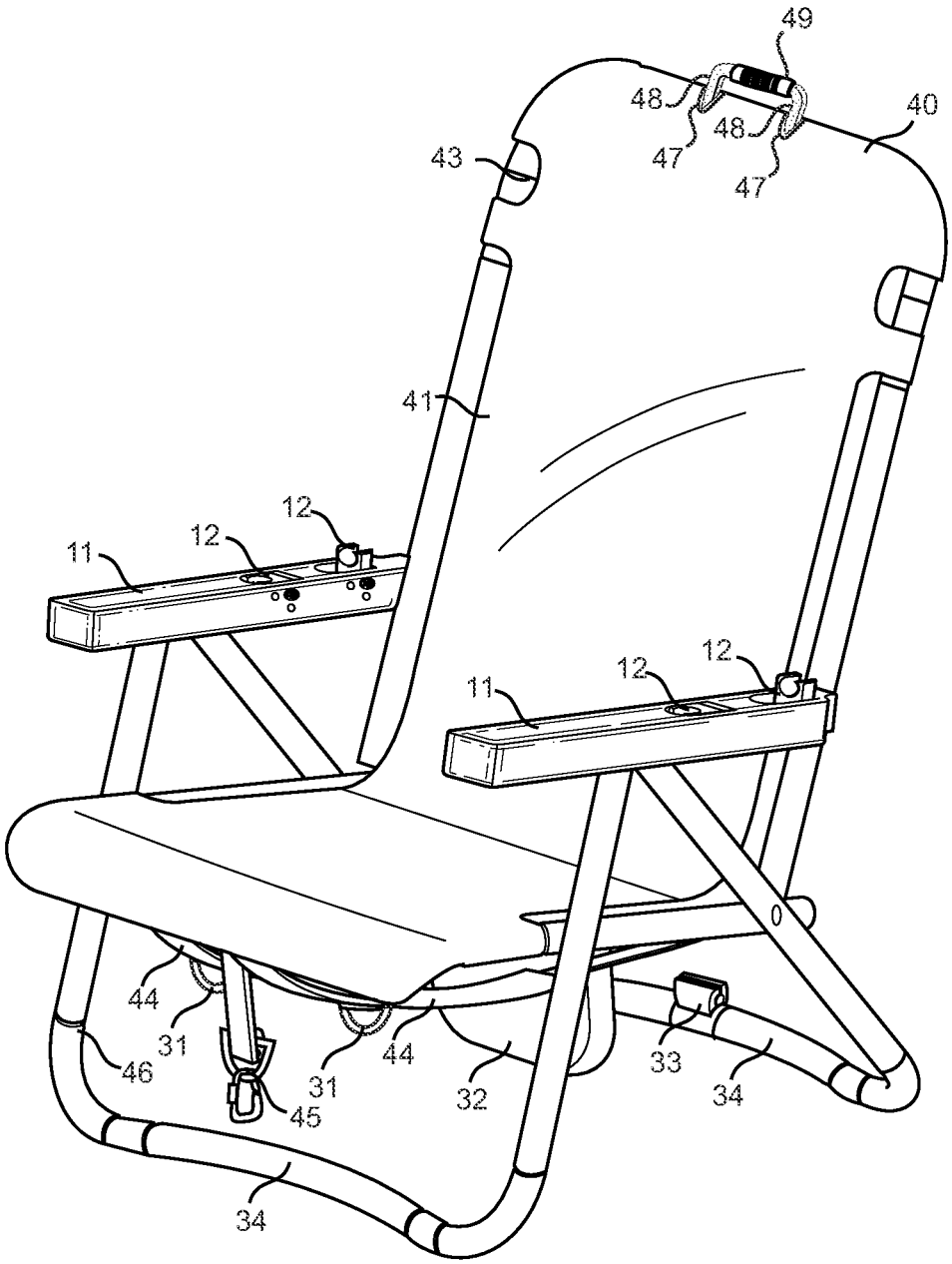
FIG. 5 shows a perspective view of an embodiment of the chair with armrest connectors showing the chair in a deployed configuration.
Figure 6:
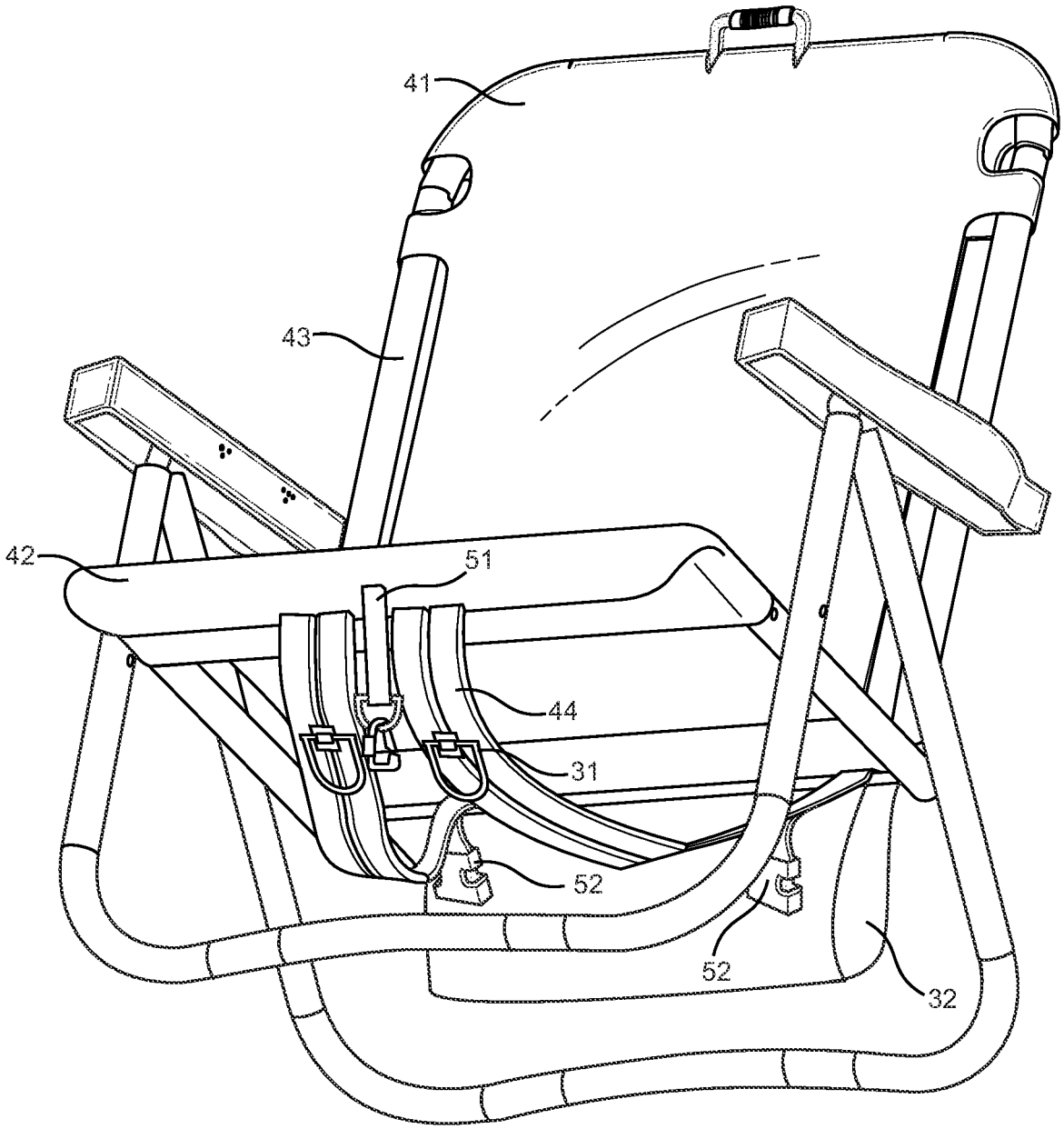
FIG. 6 shows an alternate perspective view of an embodiment of the chair with armrest connectors showing the chair in a deployed configuration.
Figure 7:
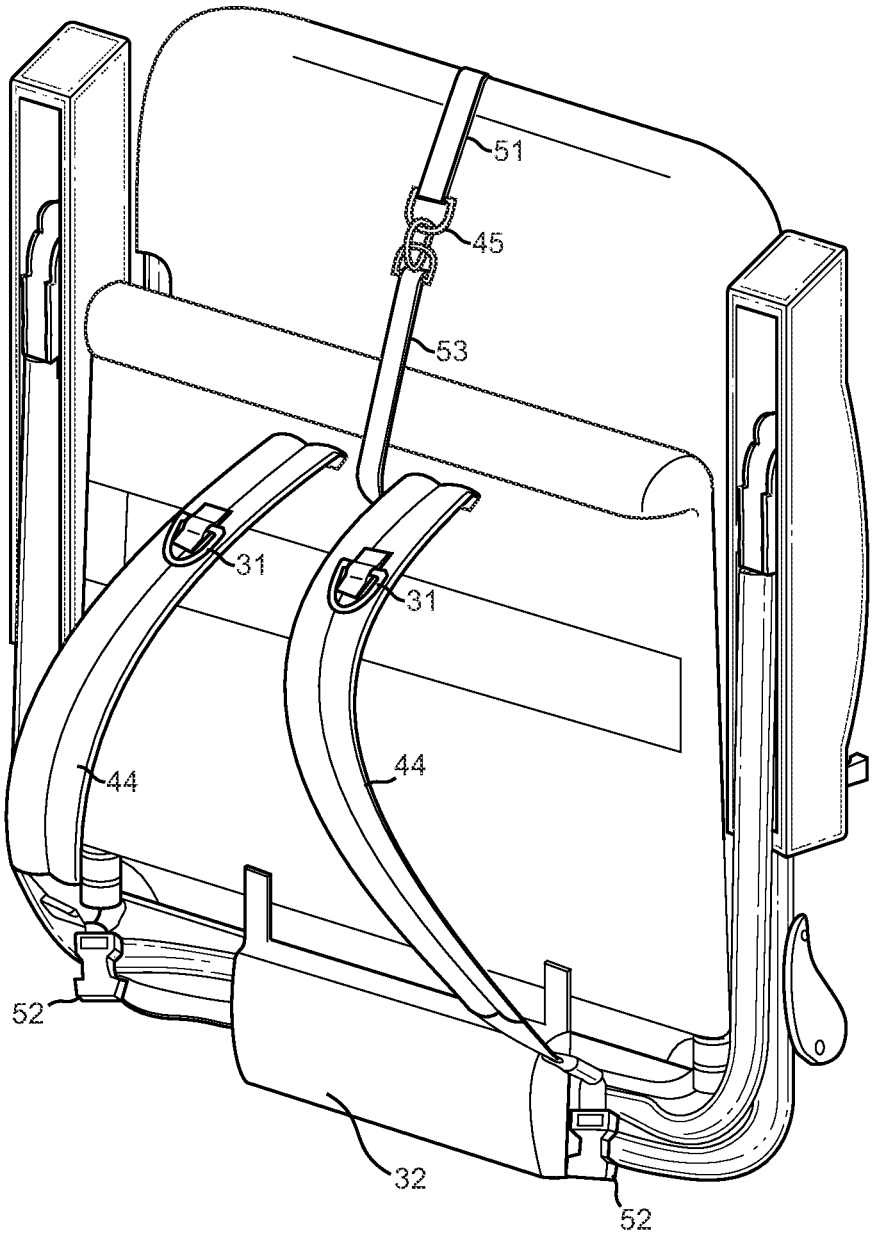
FIG. 7 shows a perspective view of an embodiment of the chair with armrest connectors showing the chair in a folded configuration.

Referring now to FIGS. 5, 6, and 7, there are shown perspective views of an embodiment of the chair with armrest connectors showing the chair in a deployed configuration. The chair 40 generally includes a backrest portion 41, a seat portion 42, a pair of armrests 11, and a supporting frame 43 including multiple pivotally connected members configured to rotate to move the chair between the folded configuration and a deployed configuration. The armrest connectors 12 are positioned on an upper side of the armrest 11, such that they are accessible when the chair 40 is folded or unfolded.

The lower end of the supporting frame includes a pair of curved lower lateral support legs 34, which connect to pivoting support legs 46. The pivoting support legs 46 extend upwardly to connect to the armrests 11, and also include connections to the framing that supports the seat portion 42. A back support pad or cushion 32 may also be attached to the lower end of the seat portion 42 for providing lower back support for the user 70. The chair 40 also includes a strap 51 attached to the seat portion 42. The strap 51 includes an attached carabiner 45 or similar fastener. The strap 51 can attach to an opposing strap 53 on an underside of the chair 40 to be utilized to secure the chair 40 in its folded configuration, as shown in FIG. 7, which shows the chair folded.

The chair 40 further includes a pair of shoulder straps 44 that can be utilized to secure the chair 40 to an individual such that the chair 40 is supported against the back when folded. The shoulder straps 44 may be adjustable in length for convenience of the user. Further, an additional strap 45 is provided for securing the chair 40 in the folded configuration. The shoulder straps 44 are positioned on an underside of the chair 40, such that the upper side of the armrest 11 is oriented outwardly and away from the rear side of the individual wearing the folded chair 40 via the shoulder straps 44, supporting the underside of the chair against the user's back. In some embodiments, the shoulder straps 44 can include slide adjusters or other mechanisms for adjusting their length for an improved fit. Further, each shoulder strap includes D-rings 31 or similar anchor points. The D-rings 31 can receive or secure additional straps or similar materials. The shoulder straps 44 can include additional fasteners 52 of any type which can be attached anywhere along the length of the straps 44 to further secure accessory items to the chair 40 when it is carried. For example, as shown in FIG. 7, the additional fasteners 52 are slide buckles 52 that can receive like fasteners on an accessory item or accessory item attachment strap.

In the shown embodiment, the chair 40 further includes a handle 49. The handle 49 includes a pair of straps that wrap around an upper portion of the frame 43 to attach to the chair 40. The straps 48 extend outwardly through openings in the material of the backrest portion 41 to connect to opposing ends of the handle 49. The handle 49 may also include ridges for improved grip. The handle 49 allows the user to easily grasp and carry the chair 40 by hand if desired.

Figure 8:
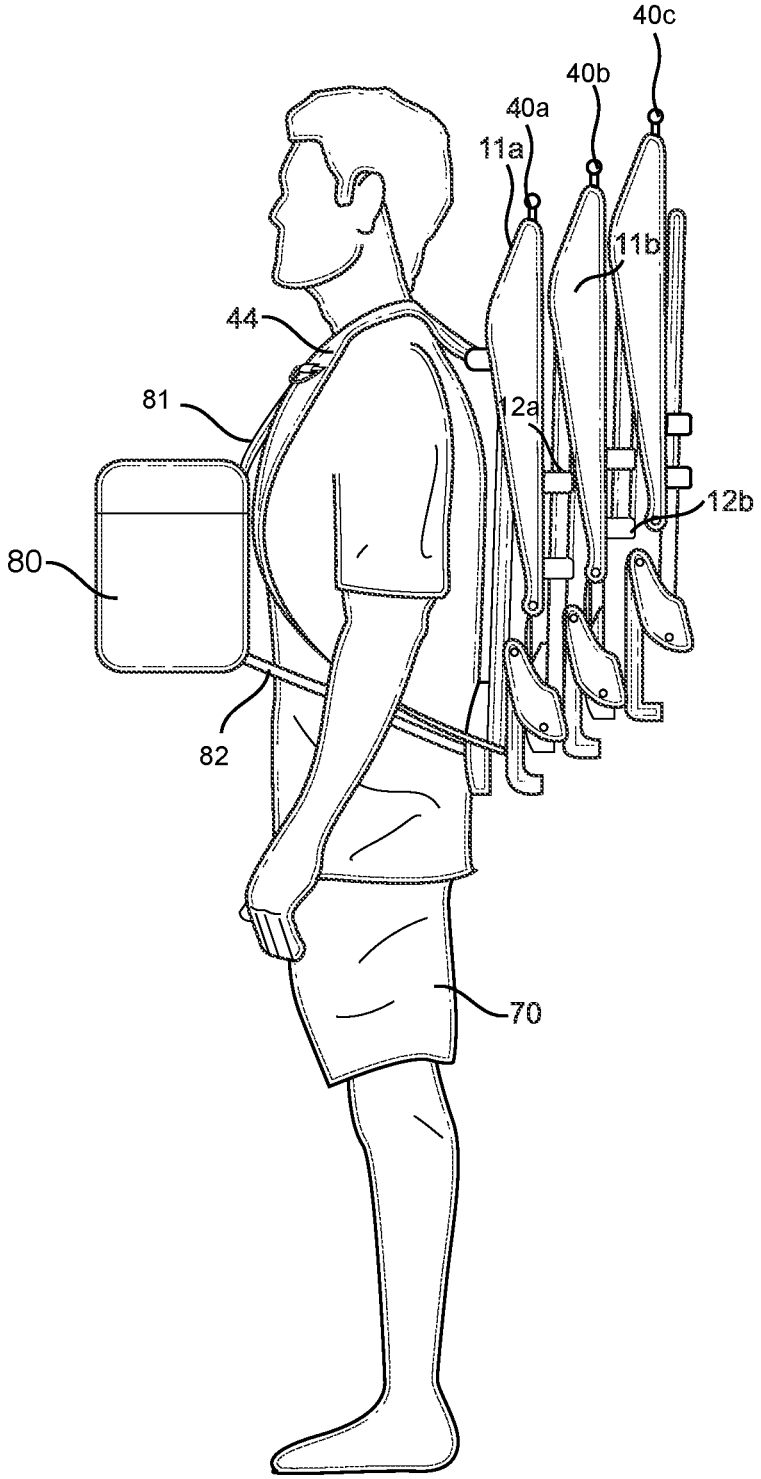
FIG. 8 shows a side elevation view of an embodiment of the chair with armrest connectors showing multiple folded chairs secured to an individual via supporting straps, as well as an additional item secured to the front of the individual.

Referring now to FIG. 8, there is shown a side elevation view of an embodiment of the chair with armrest connectors showing multiple folded chairs secured to an individual via supporting straps. In use, a first chair 40*a* is secured to the user 70 via the shoulder straps 44, such that the lower frame portion of the folded chair 40*a* contacts the user's rear side, while the armrest 11*a* faces away from the rear side of the user 70. The connectors 12*a* of the first chair 40*a* are in the deployed position, such that each connector 12*a* secures to the supporting frame of a second chair 40*b*. The second chair 40*b* is oriented such that its armrest 11*b* also faces away from the rear of the user 70, allowing a third chair's 40*c* supporting frame to be secured to the connectors 12*b* of the second chair 40*b*.

In the shown embodiment, an additional item 80 is secured to the first chair 40*a* via a pair of straps 81, 82 and any suitable fasteners. The upper strap 81 can be inserted through the D rings on the shoulder straps 44 for additional support. In the shown embodiment, the additional item is a cooler, but any type of carrying bag or any other type of item can be supported against the front side of the user 70. The straps 81, 82 can extend to connect to one of the attached chairs, and can connect at an opposing end to the shoulder straps 44. By using the additional straps 81, 82 to support the item 80 against the front of the user 70 while the chairs 40*a*, 40*b* are supported against the rear of the user 70, the present invention allows for improved weight distribution, allowing the user 70 to carry more items more comfortably and without needing to occupy the hands to do so.

Figure 9:
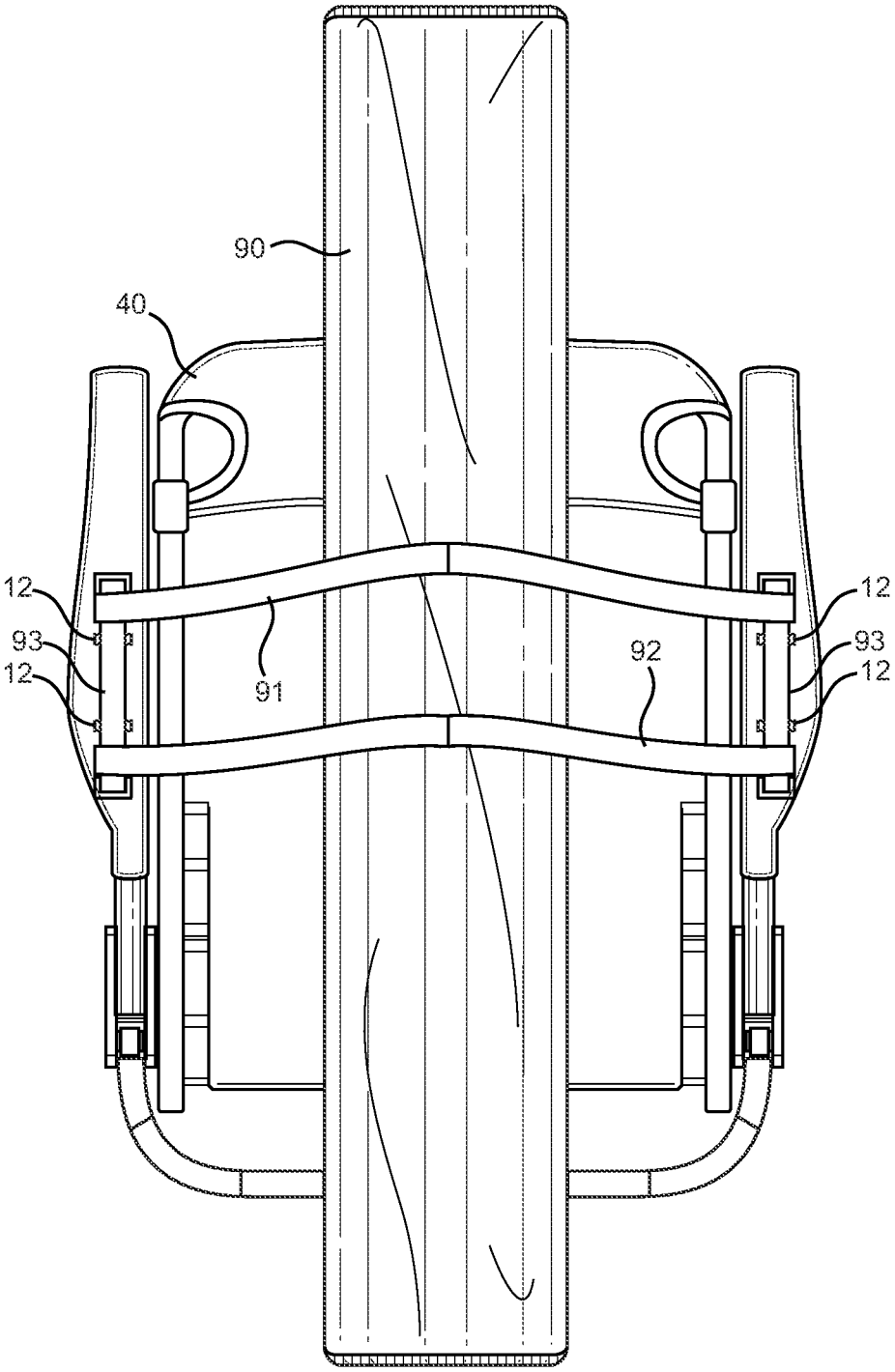
FIG. 9 shows a top plan view of an embodiment of the chair with armrest connectors in a folded configuration showing an accessory item attached to the armrest connectors.

Referring now to FIG. 9, there is shown a top plan view of an embodiment of the chair with armrest connectors in a folded configuration showing an accessory item attached to the armrest connectors. In the shown embodiment, an umbrella bag 90 includes a pair of handles 93 attached to the bag 90 with upper and lower straps 91, 92. The handles can secure to the armrest connectors 12 of the chair 40, allowing the user to carry the umbrella bag 90 along with the chair 40 supported on their shoulders. In other embodiments, any other suitable items may be secured to the armrest connectors 12 to further increase the storage and carrying capacity of the chair 40.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, and all equivalent relationships to those illustrated in the drawings and described in the specification are intended to be encompassed by the present invention.

The foregoing is considered as illustrative only of the principles of the invention. Further, it is not desired to limit the invention to the exact construction and operation shown and described, and accordingly, all suitable modifications and equivalents may be resorted to, falling within the scope of the invention.

I claim:

1. A chair with armrest connectors comprising:

a chair comprising a backrest portion, a seat portion, a pair of armrests, and a supporting frame configured to move the chair between a folded configuration and a deployed configuration;

a connector secured within a cavity disposed on an upper surface of each armrest, wherein each connector is configured to move between a deployed position extending outwardly from the cavity and a retracted position within the cavity;

wherein each connector is configured to removably secure to a supporting frame of a second chair.

2. The chair with armrest connectors of claim 1, wherein an outer surface of each armrest connector is aligned flush with an upper surface of its respective armrest when the armrest connector is in the retracted position.

3. The chair with armrest connectors of claim 1, wherein a lower interior surface of each armrest connector extends past an upper surface of its respective armrest when the armrest connector is in the deployed position.

4. The chair with armrest connectors of claim 1, wherein each armrest connector includes a locking mechanism configured to selectively maintain the armrest connector in the deployed position, wherein the locking mechanism comprises an actuator configured to release the armrest connector from the deployed position when actuated.

5. The chair with armrest connectors of claim 1, wherein the chair comprises a pair of shoulder straps.

6. The chair with armrest connectors of claim 5, wherein the pair of shoulder straps are adjustable in length.

7. The chair with armrest connectors of claim 5, further comprising attachment fasteners and D-rings configured to removably secure an item against the front side of an individual when the individual wears the pair of shoulder straps.

8. The chair with armrest connectors of claim 1, wherein each cavity disposed on the upper surface of the armrests comprises an internal stop member that is configured to prevent a respective connector from over-rotating into its respective cavity when in the folded position.

9. The chair with armrest connectors of claim 1, wherein each connector is removably secured within its respective cavity via a mounting peg extending through a pair of apertures on opposing sides of the cavity, the mounting peg comprising a fastener configured to removably secure the mounting peg within the pair of apertures.

10. The chair with armrest connectors of claim 9, wherein the fastener comprises a threaded screw fastener.

11. The chair with armrest connectors of claim 1, further comprising a securement strap having a fastener configured to secure to an opposing strap attached to the chair, which is configured to secure the chair in a folded position.

12. The chair with armrest connectors of claim 1, further comprising a back support cushion attached to a lower end of the chair.

* * * * *